US005109248A

United States Patent [19]

Petrakos et al.

[11] Patent Number: 5,109,248

[45] Date of Patent: Apr. 28, 1992

[54] VARIABLE COLOR-OUTPUT STROBE FOR PHOTOGRAPHIC APPARATUS

[75] Inventors: Stephanie Petrakos, Quincy; John P. Gaewsky, Reading, both of Mass.

[73] Assignee: Polaroid Corporation, Cambridge, Mass.

[21] Appl. No.: 586,512

[22] Filed: Sep. 21, 1990

Related U.S. Application Data

[62] Division of Ser. No. 289,693, Dec. 27, 1988.

[51] Int. Cl.[5] ..... G03B 15/05

[52] U.S. Cl. ..... 354/413; 354/132; 354/430; 315/358

[58] Field of Search ..... 354/413, 132, 21, 430; 315/358

[56] References Cited

U.S. PATENT DOCUMENTS

| | | | |
|---|---|---|---|
| 2,277,697 | 3/1942 | Grier . | |
| 3,468,228 | 9/1969 | Rogers | 95/12.20 |
| 3,942,183 | 3/1976 | Whiteside | 354/29 |
| 4,199,244 | 4/1980 | Shenk | 354/195 |
| 4,199,246 | 4/1980 | Muggli | 354/195 |
| 4,329,411 | 5/1982 | Land | 430/30 |
| 4,485,336 | 11/1984 | Yoshiyama et al. | 315/241 |
| 4,598,229 | 7/1986 | Henning et al. | 313/493 |
| 4,736,215 | 4/1988 | Hudspeth et al. | 354/21 |
| 4,853,600 | 8/1989 | Zeltner et al. | 354/132 |
| 4,978,892 | 12/1990 | Petrakos et al. | 315/358 |

*Primary Examiner*—Russell E. Adams
*Attorney, Agent, or Firm*—John J. Kelleher

[57] ABSTRACT

A single flash discharge tube system is provided that is capable of emitting artificial light of a controlled and variable spectral output to compensate for photographic film color variations and/or extremes in scene color temperature. The flash tube contains a mixture of two or more gasses with each gas in the tube having a different ionization potential. When ionized, each gas or combination thereof produces light having a different spectral output. The ionization of each gas is controlled by a trigger voltage applied to the flash tube in accordance with a code on a film container indicative of the color balance of film contained therein and/or sensing apparatus that determines scene color temperature.

5 Claims, 2 Drawing Sheets

VARIABLE COLOR-OUTPUT STROBE FOR PHOTOGRAPHIC APPARATUS

BACKGROUND OF THE INVENTION

1. Field of the Invention

This invention relates to an electronic flash apparatus capable of illuminating a scene to be photographed, in general, and to such apparatus having a controlled and variable spectral light output, in particular.

2. Description of the Prior Art

The color balance of an image formed in a photosensitive material is dependent upon several factors. One factor is the color balance of the photosensitive material itself. The continuous manufacture of large quantities of photosensitive materials over extended periods of time, especially materials of the self-developing type with their large number of coating layers, requires fairly complex processes that are relatively difficult to control. One consequence of employing such complex processes is an occasional unwanted shift in the color balance from a nominal or desired color balance, a shift that normally produces an excessive level of one particular color in an image subsequently formed in such materials. A more detailed explanation of this problem is described in U.S. Pat. No. 4,329,411 to Land.

Image color balance is also affected by the color temperature of scene illumination. The color temperature may produce a concentration of light frequencies at the higher or lower energy portions of the visible light spectrum. For example, a scene having a relatively high color temperature will have scene light predominately composed of high frequency radiation at the blue end of the visible spectrum, whereas a scene having a relatively low color temperature will have scene light predominately composed of low frequency radiation at the red end of the visible spectrum.

Optical filters have been employed in the past for balancing the color of an image formed in photosensitive materials located within a photographic camera. In commonly assigned U.S. Pat. No. 4,736,215 to Hudspeth et al, for example, a film cassette is provided with indicia or machine readable information on an external surface thereof corresponding to one or more film variables of a film unit enclosed within the film cassette. A camera into which the film casette is insertable is provided with three optical filters for controlling photosensitive material color balance, each of which is selectively movable into the optical axis of a taking lens of the photographic camera under control of signals developed by reading means within the camera responsive to the film cassette indicia In commonly assigned U.S. Pat. No. 3,468,228 to Rogers, an automatic shutter mechanism for a photographic camera is disclosed which incorporates a selection of color balancing filters. The filters compensate for color balance shifts produced by scene color temperature. Optical filter systems that are effective in automatically controlling the color balance of an image formed in photosensitive materials have previously been incorporated in photographic apparatus. However, these optical filter systems significantly increase both the cost and size of the apparatus in which they are employed.

In U.S. Pat. No. 4,485,336 to Yoshiyama et al, for example, an electronic flash device is provided in which the color temperature of the flash of artificial light is controlled so that it can compensate for color imbalance in a photosensitive material or a color imbalance caused by scene color temperature. The electronic flash device includes three different xenon flash tubes with each such tube having a red, green or blue filter through which light from a xenon flash tube is transmitted. The particular flash tube and filter employed, and therefore the color of light emitted by the electronic flash device, is dependent upon an operator selected characteristic of the photosensitve material and/or the automatically sensed scene color temperature. While effective in compensating for photosensitive material and scene color temperature produced color imbalance, this electronic flash device is relatively complex and the multiple flash tubes require considerably more space than a flash arrangement where, for example, a single flash tube might be employed for such purposes.

SUMMARY OF THE INVENTION

It is a primary object of the present invention, therefore, to provide a single flash tube which can emit light having certain desired spectral characteristics.

It is another object of the present invention to provide a single flash tube wherein the spectral characteristics of its emitted light can be selectively varied.

It is a further object of the present invention to provide a single flash tube wherein the spectral characteristics of its emitted light can be varied in accordance with sensed scene color temperature and/or the color balance characteristics of a photosensitive material.

In accordance with a preferred embodiment of the present invention, a flash discharge lamp is provided which is capable of emitting artificial light of a controlled and variable spectral output. The flash discharge lamp contains a mixture of two or more gases with each gas in the lamp having a different ionization potential. When ionized, each gas or combination thereof produces light having a different spectral output. The ionization of each gas is selectively controlled by a trigger voltage that is applied to the flash discharge lamp in accordance with one or more criteria establishing the preferred lighting conditions.

DESCRIPTION OF THE PREFERRED EMBODIMENT

Figure 1:
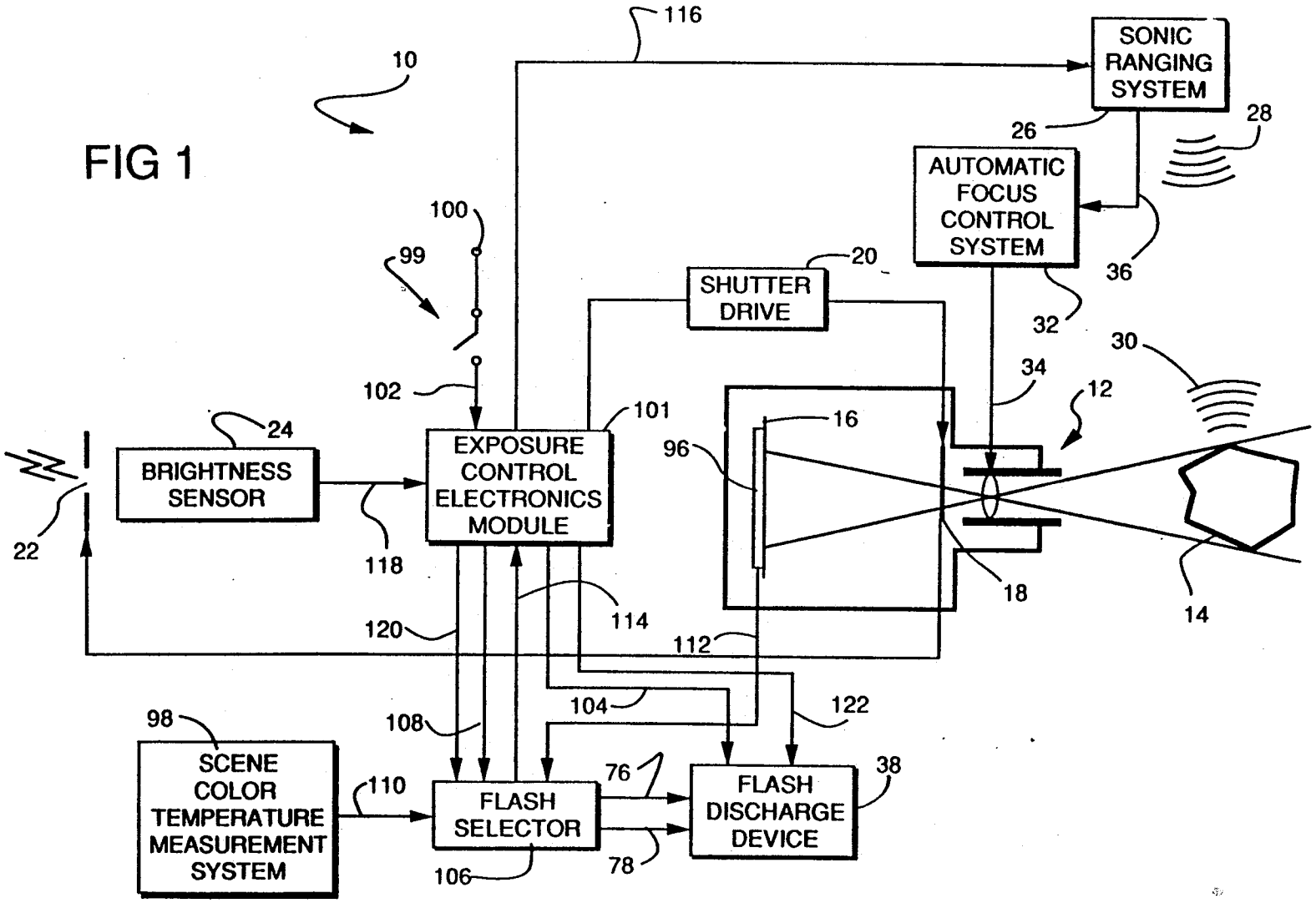
FIG. 1 is a schematic diagram of a photographic camera which incorporates a preferred embodiment of the flash discharge lamp of the present invention.

Referring now to the drawings, and specifically to FIG. 1, there is shown a single lens reflex (SLR) photographic camera 10 of the self-developing type which incorporates a preferred embodiment of the variable color-output flash discharge lamp of the present invention. The camera 10 includes an objective or taking lens 12 comprising a plurality of elements (not shown) retained in a spaced relation by a conventional cylindrical lens mount which may be adapted in a well-known manner to provide translational movement of the elements of the lens 12 along a central optical axis for focusing image-carrying light rays of, for example, an object 14 on a film plane 16 through an aperture formed in a shutter assembly 18.

The shutter assembly 18, positioned intermediate of the lens 12 and the film plane 16, includes a pair of overlapping shutter blade elements (not shown in detail) of the "scanning" type. Scene light admitting primary apertures (not shown) are provided in each of the shutter blade elements to cooperatively define a progressive variation of effective aperture openings in accordance with simultaneous longitudinal and lateral displacement of one blade element with respect to the other blade element in a manner more fully described in commonly assigned U.S. Pat. No. 3,942,183 to Whiteside, now specifically incorporated herein by reference. The blade element apertures are selectively shaped so as to overlap the central optical axis of the lens 12 thereby defining a gradually varying effective aperture size as a function of the position of the blade elements of the shutter assembly 18. A shutter drive 20 is provided for displacing the shutter blade elements of the shutter assembly 18. The shutter drive 20 includes a tractive electromagnetic device in the form of a solenoid (not shown) employed to displace the shutter blade elements with respect to one another in a manner more fully described in the above-noted Whiteside patent.

Each of the shutter blade elements of the shutter assembly 18 includes a secondary aperture with an aperture in one blade element cooperating with an aperture in another blade element to form an opening 22 therethrough. These secondary apertures may be configured to track in a predetermined corresponding relationship with respect to the scene light admitting primary apertures of the shutter assembly 18. With the primary and secondary apertures being formed in the same blade elements and therefore being mechanically coupled to one another, it is readily apparent that the secondary apertures can move in the same manner as the primary apertures when controlling scene light passing through the secondary-aperture-formed opening 22 transmitted from a scene being photographed to a photoresponsive element (not shown) forming a part of a brightness sensor 24. An example of scanning blade elements having primary and secondary apertures that cooperate to control the amount of scene light admitted to a photoresponsive element is shown in U.S. Pat. No. 3,942,183, supra.

The photographic camera 10 is provided with a sonic ranging system 26 that includes a ranging circuit and an ultrasonic transducer (neither shown) which may be actuated to transmit a burst of sonic energy 28 toward a subject to be photographed, such as the subject 14. The transducer thereafter operates to detect an echo 30 of the burst of sonic energy reflected from the subject 14. The total round-trip time for a burst of sonic energy to be transmitted toward and an echo thereof to be reflected from the subject 14 and detected by the transducer in the sonic ranging system 26 is a fairly accurate measure of camera-to-subject distance. An electrical signal representative of this round-trip time is subsequently employed to focus the adjustable focus lens 12. U.S. Pat. No. 4,199,246 to Muggli describes such a sonic rangefinder in much greater detail. An automatic focus control system 32, coupled to the adjustable focus lens 12 through a path 34, causes the lens 12 to focus a sharp image of the subject 14 on the film plane 16 during an exposure interval in response to an electrical signal from the sonic ranging system 26 through a path 36, a signal representative of the distance between the subject 14 and the camera 10. An example of an automatic focus control system functioning in this manner is more fully described in U.S. Pat. No. 4,199,244 to Shenk.

Figure 2:
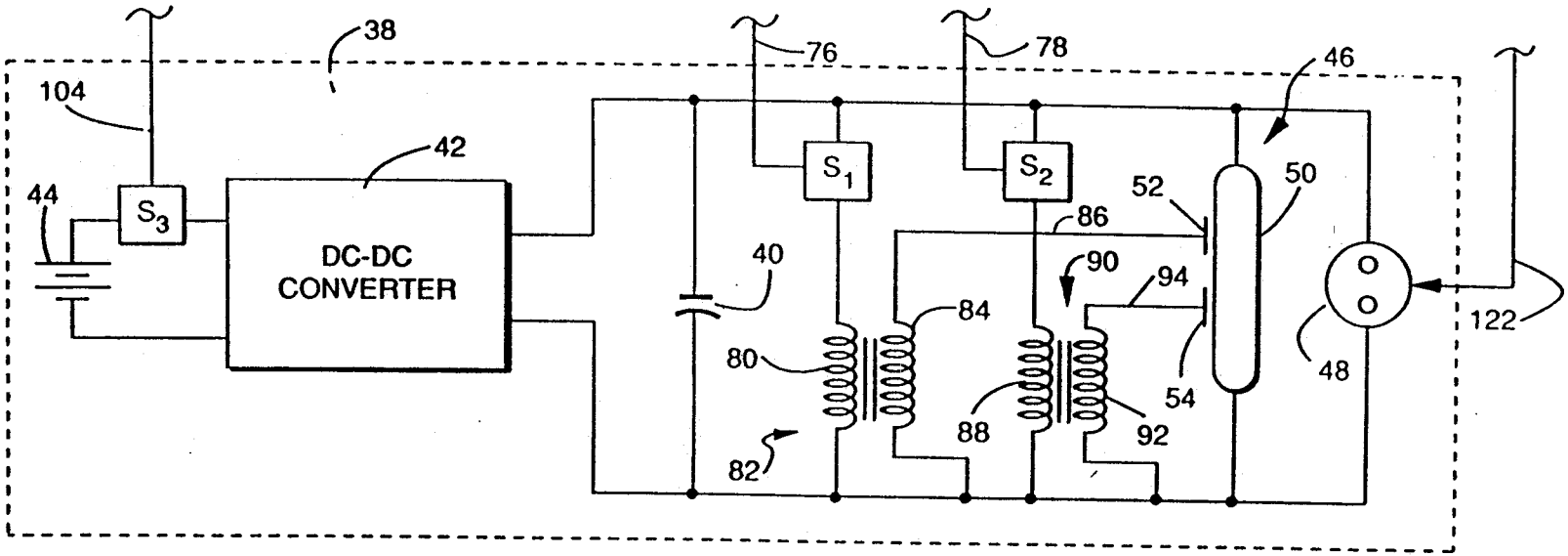
FIG. 2 is a schematic diagram of the flash discharge device employed in the camera of FIG. 1 which incorporates the flash discharge lamp of the present invention.

The camera 10 is provided with a flash discharge device 38 together with means for controlling the energization of same to provide a portion of the illumination required to illuminate a scene to be photographed. As shown in FIG. 2, the flash discharge device 38 comprises a main storage capacitor 40 which may be charged up to an operating voltage by any conventional voltage converter such as a DC-DC converter 42. The DC-DC converter 42 operates in a conventional manner to convert a DC voltage as may be derived from a battery 44, which can be in the order of 6 VDC, to a suitable operating voltage such as 350 VDC. A flash discharge tube 46 and a conventional quench tube 48 for interrupting the light output of the flash discharge tube 46 are connected in parallel relation with respect to the storage capacitor 40.

The flash discharge tube 46 comprises an airtight glass enclosure 50 that may contain a mixture of two or more gases such as argon, krypton, neon, xenon or the like having different ionization potentials. The gases argon, krypton, neon and xenon, for example, have ionization potentials of approximately 15.69, 13.94, 21.47 and 12.08 electronvolts (eV), respectively. Also, when ionized, each such gas produces a source of illumination having a different spectral energy distribution output.

Figure 3B:
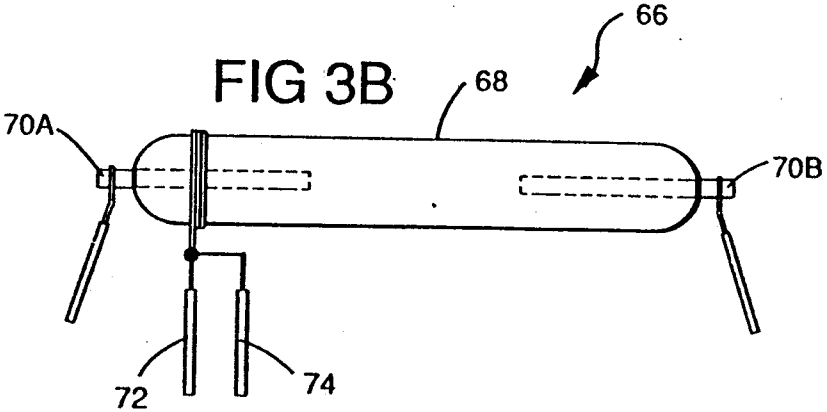
FIGS. 3A and 3B are flash discharge lamps of the present invention which incorporate two separate electrodes and a single electrode, respectively, in the form of conductors that are tightly wrapped around the external surface of their respective discharge lamps, for coupling two different ionization potentials to a gas mixture enclosed therein.
Figure 3A:
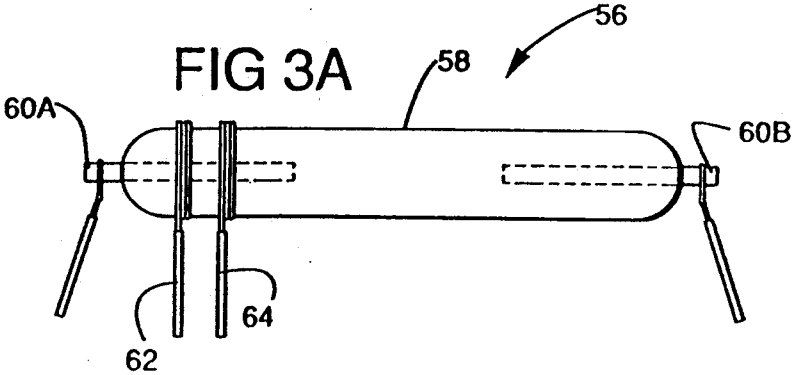

In this particular embodiment, two different gases are contained within the glass enclosure 50 of the flash discharge tube 46. The different ionization potentials employed to ionize one or both of these gases would be applied to a pair of ionization electrodes 52 and 54 that are schematically shown in drawing FIG. 2 In actual practice, a flash discharge tube enclosing the two different gases and having means for coupling externally generated ionization potentials to these gases for gas ionization purposes might take the forms shown in drawing FIGS. 3A or 3B. In FIG. 3A, for example, a flash discharge tube 56 has an airtight glass enclosure 58 that contains two gases having different ionization potentials. Electrodes 60A and 60B at the opposite ends of the enclosure 58 directly couple an external voltage source, such as that provided by the main storage capacitor 40 in drawing FIG. 2, to the gases contained therein such that when the gases are ionized the external voltage source causes a light-producing ionization current to flow therebetween after ionization has been initiated. Each of a pair of electrical conductors 62 and 64 have their bare ends tightly wrapped around the outer surface of the enclosure 58 to form a pair of ionization electrodes. The ionization potential applied to these ionization electrodes, which are capacitively coupled to the enclosed gases through the enclosure 58, cause any enclosed gas to ionize if its ionization potential is equal to or greater than the applied ionization potential. Similarly, a flash discharge tube 66 has an airtight gas enclosure 68 that also contains two gases having different ionization potentials. Electrodes 70A and 70B at the opposite ends of the airtight glass enclosure 68 also directly couple an external voltage source, such as that mentioned above with respect to FIG. 3A, to the gases contained therein between which the light-producing ionization current flows. Electrical conductors 72 and 74 are connected to a single uninsulated conductor that is tightly wrapped around the outer surface of the enclosure 68 in the form of a single ionization electrode. The different ionization potentials applied to conductors 72 and 74 are also capacitively coupled to the contained gases through the enclosure 68.

Referring again to FIG. 2, the magnitude of the ionization potential applied to the flash discharge tube 46 is dependent, in part, upon whether or not a trigger signal is applied to a path 76 or to a path 78 coupled to the flash discharge device 38. If a trigger signal is applied to the flash discharge device 38 through the path 76, a switch $S_1$, which preferably is of the solid state type, will be actuated to its conducting state to thereby apply a portion of the energy in the main storage capacitor 40 to a primary coil 80 of a voltage step-up transformer 82. The increased voltage developed in a secondary coil 84 of the transformer 82, which is of sufficient magnitude to ionize one of the gases within the enclosure 50, is applied to said one gas through a path 86 and the electrode 52. When one of the gases is ionized, its electrical resistance is lowered, thereby allowing the main capacitor 40 to discharge its energy through the flash discharge tube 46 in the form of a flash of light having a particular spectral distribution.

Similarly, if a trigger signal is applied to the flash discharge device 38 through the path 78, a switch $S_2$ will be actuated to its conducting state to thereby apply a portion of the energy in the main storage capacitor 40 to a primary coil 88 of a voltage step-up transformer 90. The increased voltage developed in a secondary coil 92 of the transformer 90, which is of sufficient magnitude to ionize both gases within the enclosure 50, is applied to both gases through a path 94 and the electrode 54. When these gases are ionized, the main capacitor 40 is able to discharge its energy through the flash discharge tube 46 and thereby produce a flash of light having a spectral distribution that is a composite of the spectral distribution of each ionized gas within the enclosure 50.

The camera 10 is adapted to receive a film cassette 96 that is provided with indicia or machine readable information on an external surface thereof corresponding to the color balance of the film units enclosed therein. The camera 10 also includes a scene color temperature measurement system 98, a system similar to that employed in the Color Meter II color measuring meter manufactured by the Minolta Corporation of Japan. A signal representative of scene color temperature is obtained, in part, by photocells within the system 98 that simultaneously measure the ratio of blue to red scene light. This ratio is a useful, albeit an imperfect, measure of scene color temperature.

OPERATION

A typical exposure cycle that includes the selection of one or more ionization potentials will now be described in detail. With reference to FIGS. 1 and 2 of the drawings, a switch 99 is actuated to its closed position by a camera operator, thereby coupling a souce of electrical power (not shown) connected to a terminal 100 to an exposure control electronics module 101 through a path 102. Electronics module 101, in turn, applies a control signal to a switch $S_3$ (FIG. 2) within the flash discharge device 38 through a path 104 to thereby cause the output of the battery 44 included therein to be applied to an input of the DC-DC converter 42. Converter 42, in turn, causes the main storage capacitor 40 to be charged to a predetermined voltage level. At the same time, electronics module 101 applies a signal to a flash selector 106 through a path 108 causing the scene color temperature signal derived by the measurement system 98 and coupled to the selector 106 through a path 110 to be combined within the selector 106 with the film color balance information encoded in the indicia on the external surface of the film cassette 96 and routed to the selector 106 through a path 112. This combined scene color temperature and film color balance information is, in turn, routed to the electronics module 101 through a path 114 where it is employed to determine which gas or gases within the flash tube 46 are to be ionized and for how long.

As noted above, the camera 10 is of the SLR type and employs scanning-type shutter blades. When the exposure control electronics module 101 is activated by the closure of the switch 99, it also causes the sonic ranging system 26 to be actuated through a path 116 to determine the distance to the subject 14 and causes the scanning blade shutter of the shutter mechanism 18 to be actuated to its closed or light blocking position by the shutter drive 20. The subject 14 distance information established by the sonic ranging system 26 is applied to the automatic focus control system 32 through the path 36 wherein, in response thereto, the control system 32 positions the taking lens 12 through the path 34 to the correct focus position.

After the positioning of the scanning blade shutter to its closed position and the focusing of the taking lens 12, the exposure control electronics module 101 causes the shutter drive 20 to actuate the shutter assembly 18 coupled thereto and thereby generate an exposure interval. This exposure interval is generated in correspondence with a scene light brightness level signal generated by the brightness sensor 24 and routed to the electronics module 101 through a path 118 and in correspondence with the previously described combined scene color temperature and film color balance information.

If it should be determined from the combined scene color temperature and color balance information that a certain amount of artificial light having a particular spectral content must be employed to illuminate a scene to be photographed during an exposure interval, the exposure control electronics module 101 would apply a coded signal to the flash selector 106 through a path 120 causing the selector 106 to, for example, apply a trigger voltage to the switch $S_1$ within the flash discharge device 38 (FIG. 2) through the path 76, thereby causing the energy stored within the main storage capacitor 40 to be applied to the voltage step-up transformer 82. The output voltage of the transformer 82 is applied to a gas within the enclosure 50 which ionizes same to thereby produce a flash of light having the desired spectral content. A subsequent trigger signal from the exposure control electronics module 101 to the quench tube 48 through a path 122 terminates the light output of the flash discharge tube 46 when the requisite amount of artificial light has illuminated the scene being photographed during the exposure interval.

If it should be determined that the spectral content of both gases contained within the enclosure 50 must be employed to illuminate the scene, a different coded signal would be sent to the flash selector 106 through the path 120 causing the selector 106 to apply a trigger voltage to the switch $S_2$ within the flash discharge device 38 through the path 78 which, in turn, would cause the energy in the storage capacitor 40 to be applied to the voltage step-up transformer 90. The output voltage of the transformer 90 is applied to both gases within the enclosure 50 thereby ionizing same and thereby producing a composite flash of light having the spectral content of each constituent gas. In the same manner described above, a trigger signal from the exposure control electronics module 101 to the quench tube 48 through the path 122 terminates the light output of the flash discharge tube 46 when the requisite amount of artificial light has illuminated the scene being photographed during an exposure interval.

It should be noted that, if necessary, the spectral output of the gases within the enclosure 50 can be time modulated. For example, if one gas had a particular ionization potential and a spectral output content at the red end of the visible spectrum and another gas had a higher ionization potential and a spectral output content at the blue end of the visible spectrum, the amount of red light illuminating a scene may be substantially increased over the amount of blue light illuminating the same scene by time modulation in the following manner. If, for example, it is determined that a certain amount of artificial red light and one-half this amount of artificial blue light is required to illuminate a particular scene, two different ionization potentials would be successively applied to the flash discharge tube 46. The gas that emits red light must be ionized first because it ionizes at the lower potential and the duration of the flash resulting from such ionization would be limited to one-half of the total time necessary to illuminate the scene being photographed with the requisite amount of red light. After the red light emitting gas has been ionized for this period of time, the ionization potential that ionized the red light emitting gas is raised to a level that will ionize both the red light emitting and the blue light emitting gases. Quench tube 48 would then be employed to terminate the output of the flash in a conventional manner. The duration of the flash resulting from the ionization of both the red light emitting and blue light emitting gases would be limited to the same period of time that the red light emitting gas had previously illuminated the scene being photographed. By controlling the flash duration of the flash discharge device 38 in this manner, one-third of the artificial light illuminating the scene being photographed will have a blue content and the remaining two-thirds will have a red content. It should be noted that more than two gasses having different ionization potentials that emit light of a different color may also be employed within the enclosure 50 and their light output would be controlled in a similar manner. It should also be noted that whenever a potential is applied to a mixture of gases in the flash discharge tube 46 of FIG. 2, all of the gases enclosed therein having an ionization potential equal to or less than the applied potential will be ionized to produce a flash of light. Only those gases within the flash discharge tube having an ionization potential greater than the applied potential will not be so ionized.

In the above-described preferred embodiment, two voltage step-up transformers 82 and 90 are provided in the flash discharge device 38 to ionize either one of the two different gases contained therein or both of them. With this particular gas ionization scheme, a separate voltage step-up transformer must be provided for gas ionization purposes for the gas having the lowest ionization potential and for each combination of gases contained within a flash discharge tube such as the flash discharge tube 46. Other arrangements could also be used to generate the requisite ionization potentials. One arrangement might be the use of a variable gain amplifier at the output of the main storage capacitor 40 in the flash discharge device 38 shown in drawing FIG. 2 that feeds a single voltage step-up transformer. The extent to which the gain is varied to produce ionization would be determined by the combined scene color temperature and film color balance information mentioned above. Another arrangement might be the use of several main storage capacitors in place of the single main storage capacitor 40 in the flash discharge device 38 equal to the number of gases enclosed within the flash discharge device 48 that could be selectively coupled to a single voltage step-up transformer. Each such capacitor would store a different amount of energy and the selection of a particular capacitor for coupling to the voltage step-up transformer input would also be determined by the combined scene color temperature and film color balance information mentioned above.

From the foregoing description of the invention, it will be apparent to those skilled in the art that various improvements and modifications can be made in it without departing from its true scope. The embodiment described herein is merely illustrative and should not be viewed as the only embodiment that might be encompassed by the invention.

What is claimed is;

1. A flash discharge device for illuminating a scene to be photographically exposed, comprising:

an airtight housing through which light may be transmitted toward the scene to be photographically exposed, for enclosing a gaseous mixture;

a mixture of gases contained within said housing, with at least two of the gasses forming said mixture having different ionization potentials;

means for generating at least two electrical potentials with each such electrical potential having a different potential magnitude; and means responsive to a signal representative of the scene color temperature and/or a signal representative of the color balance of a photosensitive material being used to record the scene for selectively coupling one of said electrical potentials to said gas mixture to ionize one of the gases included therein without ionizing another and thereby generate a source of light having a particular spectral content and subsequently transmit said light outwardly of said airtight housing and toward the scene to be photographed.

2. The flash discharge device of claim 1 wherein said selective coupling means includes a single gas-ionizing electrode and each of said gas ionizing output potentials are selectively coupled to said enclosed gas mixture through said single gas-ionizing electrode.

3. The flash discharge device of claim 1 wherein said selective coupling means includes a number of different gas-ionizing electrodes equal to the number of gases forming said gas mixture with each such electrode selectively coupling a single ionization potential thereto.

4. Photographic apparatus adapted to receive a film cassette having indicia thereon representative of the color balance of photosensitive material contained therein, and including a flash discharge device for providing artificial illumination during an exposure cycle, said photographic apparatus comprising;

a housing;

an airtight enclosure mounted on said housing, through which light maybe transmitted toward a scene to be photographically exposed;

a mixture of gases contained within said enclosure, with at least two of the gases forming said mixture having different ionization potentials;

means for generating at least two electrical potentials with each such electrical potential having a different potential magnitude;

means for generating a signal representative of the scene color temperature;

means responsive to the color balance information encoded in the film cassette indicia for generating a signal representative thereof;

means for initiating a photographic exposure cycle; and means responsive to said scene color temperature signal and/or said color balance signal for selectively coupling one of said electrical potentials to said gas mixture to ionize one of the gases included therein without ionizing another to thereby generate a source of light having a particular spectral content and thereby transmit said light toward the scene to be photographed during an exposure cycle.

5. The photographic apparatus of claim 4 wherein said selective coupling means time modulates the coupling of said output potentials to said gas mixture.

* * * * *